US008069686B2

(12) United States Patent
Cho et al.

(10) Patent No.: US 8,069,686 B2
(45) Date of Patent: Dec. 6, 2011

(54) REFRIGERATOR

(75) Inventors: Nam Soo Cho, Seoul (KR); Youn Seok Lee, Seoul (KR); Kyeong Yun Kim, Seoul (KR); Su Nam Chae, Seoul (KR); Jang Seok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 694 days.

(21) Appl. No.: 12/170,826

(22) Filed: Jul. 10, 2008

(65) Prior Publication Data

US 2009/0013713 A1 Jan. 15, 2009

(30) Foreign Application Priority Data

Jul. 11, 2007 (KR) ..... 10-2007-0069743

(51) Int. Cl.
*F25D 11/00* (2006.01)

(52) U.S. Cl. ..... 62/440; 62/443

(58) Field of Classification Search ..... 441/440, 441/441, 419, 443, 407; 62/440, 441, 419, 62/443, 407, 196.1
See application file for complete search history.

(56) References Cited

U.S. PATENT DOCUMENTS

| | | | | |
|---|---|---|---|---|
| 5,953,932 | A * | 9/1999 | Kwon | 62/297 |
| 6,718,793 | B2 * | 4/2004 | Lee | 62/453 |
| 6,735,976 | B2 * | 5/2004 | Lee | 62/419 |
| 7,188,490 | B2 * | 3/2007 | Jeong et al. | 62/448 |
| 7,549,300 | B2 * | 6/2009 | Chun et al. | 62/419 |
| 7,883,229 | B2 * | 2/2011 | Choi | 362/94 |
| 2002/0069669 | A1 * | 6/2002 | Lee | 62/525 |
| 2002/0127110 | A1 * | 9/2002 | Jung et al. | 416/238 |
| 2003/0005720 | A1 * | 1/2003 | Lee | 62/452 |
| 2004/0000162 | A1 | 1/2004 | Song | |
| 2004/0163408 | A1 * | 8/2004 | Kim et al. | 62/428 |
| 2005/0115272 | A1 * | 6/2005 | Lim et al. | 62/507 |
| 2005/0120738 | A1 * | 6/2005 | Chun et al. | 62/455 |
| 2006/0137378 | A1 * | 6/2006 | Choi | 62/264 |
| 2007/0163284 | A1 * | 7/2007 | Kim et al. | 62/342 |
| 2008/0164016 | A1 * | 7/2008 | Lee et al. | 165/178 |

FOREIGN PATENT DOCUMENTS

| | | | |
|---|---|---|---|
| AU | 762033 | | 3/2000 |
| CN | 1248690 | A | 3/2000 |
| CN | 1313496 | A | 9/2001 |
| CN | 1467464 | A | 1/2004 |
| CN | 1704706 | A | 12/2005 |
| JP | 8-68587 | * | 3/1996 |
| JP | 2005-233434 | A | 9/2005 |

OTHER PUBLICATIONS

Abstract of JP 8-68587 to Endo et al.*
Translation of JP 8-68587 to Endo et al.*

* cited by examiner

*Primary Examiner* — Mohammad Ali
(74) *Attorney, Agent, or Firm* — Birch, Stewart, Kolasch & Birch, LLP

(57) ABSTRACT

A refrigerator including a body having a plurality of cooling compartments separated from each other by a partition, and a machine room defined by the partition in a lower region of one of the plurality of cooling compartments. The machine room receives predetermined elements required to operate the cooling compartments.

7 Claims, 9 Drawing Sheets

REFRIGERATOR

CROSS REFERENCE TO A RELATED APPLICATION

This application claims the benefit of the Korean Patent Application No. 10-2007-0069743 filed on Jul. 11, 2007, which is hereby incorporated by reference as if fully set forth herein.

BACKGROUND OF THE INVENTION

1. Field of the Invention

The present invention relates to a refrigerator, and more particularly to a refrigerator, in which the size of a machine room is reduced without a degradation in the efficiency of a refrigeration cycle, resulting in an enlarged volume of a cooling compartment.

2. Discussion of the Related Art

Generally, a refrigerator includes cooling compartments, such as a refrigerating compartment and a freezing compartment, and maintains food, etc. stored in the cooling compartments at a low temperature for a long time by supplying cold air into the cooling compartments. Further, the cold air is generated by a refrigeration cycle apparatus including a compressor, a heat exchanger, etc.

The refrigeration cycle apparatus includes a compressor to compress a refrigerant, a condenser and a heat-radiation fan to condense the refrigerant compressed in the compressor, an expander to expand the condensed refrigerant, and an evaporator to absorb heat from the surrounding air in the process of evaporating the expanded refrigerant so as to create a low-temperature atmosphere.

The refrigerator generally further includes a space referred to as a machine room. The above mentioned compressor, condenser, and heat-radiation fan, etc. are mounted in the machine room.

In more detail, FIGS. 1 and 2 illustrate a configuration of a machine room defined in a related art refrigerator. As shown in FIG. 1, the related art refrigerator includes a machine room 1 provided in a lower end region of a refrigerator body 10 to extend lengthwise in a horizontal direction.

Assuming the related art refrigerator is a double-door refrigerator, the interior of the body 10 is divided into left and right spaces, namely, a freezing compartment and a refrigerating compartment having predetermined volumes, respectively. Further, the machine room 1 shown in FIG. 1 is located below both the freezing compartment and the refrigerating compartment.

Specifically, as shown in FIG. 1, the machine room 1 includes a compressor 2, a condenser 3, and a heat-radiation fan 4. The machine room 1 is covered with a cover 5. In addition the cover 5 has a suction hole 6 and a discharge hole 7, which are spaced apart from each other by a predetermined distance for the circulation of air into the machine room 1.

The related art machine room having the above described configuration, however, has a problem of occupying a significantly large area in the refrigerator, and thus reducing the volume of the cooling compartments. Moreover, the above mentioned double-door refrigerator inevitably undergoes a reduction in volume in both the freezing compartment and the refrigerating compartment.

Further, with the configuration that the air moves through the suction hole 6 and the discharge hole 7 formed in the cover 5, as shown in FIG. 1, the movement direction of air blown by the heat-radiation fan 4, the movement direction of air suctioned through the suction hole 6, and the movement direction of air discharged through the discharge hole 7 are perpendicular to one another. Therefore, it is difficult to assure the smooth circulation of air within the machine room 1.

Meanwhile, as shown in FIG. 2, a lower end region of a cooling compartment 14, i.e. the space A designated by a dashed line, has a limited volume due to the presence of the machine room 1. The volume of the space A is further limited by a heat-insulating material 13 filled in an outer shell 11 and an inner shell 12 of the body 10.

The cooling compartment 14 includes a rear panel 15 to partition a space for receiving an evaporator (not shown) and a blowing fan (not shown). As shown, the panel 15 includes a cold air suction hole 16 and a cold air discharge hole (not shown), such that cold air blown by the blowing fan is supplied into the cooling compartment 14 through the cold air discharge hole, and be again suctioned to the evaporator through the cold air suction hole 16.

However, because the volume of the space A is limited due to the volume of the machine room 1, and in particular, the lower end of the space A is located at a long distance from the cold air suction hole 16, the related art refrigerator has a problem in that the cold air within the cooling compartment 14 stagnates in the space A, and thus fails to circulate smoothly in the cooling compartment 14.

To solve the above described problems, the space A may be reduced or eliminated, but this method excessively increases the volume of the machine room 1, and on the other hand, excessively decreases the inner volume of the cooling compartment.

SUMMARY OF THE INVENTION

Accordingly, one object of the present invention is directed to a refrigerator that substantially obviates one or more problems due to limitations and disadvantages of the related art.

Another object of the present invention is to provide a refrigerator in which the size of a machine room is reduced without a degradation in the efficiency of a refrigeration cycle, which results in an enlarged inner volume of a cooling compartment.

To achieve these objects and other advantages and in accordance with the purpose of the invention, as embodied and broadly described herein, the present invention provides in one aspect a refrigerator including a body having a plurality of cooling compartments separated from each other by a partition, and a machine room defined by the partition in a lower region of one of the plurality of cooling compartments. Further, the machine room receives predetermined elements required to operate the cooling compartments.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
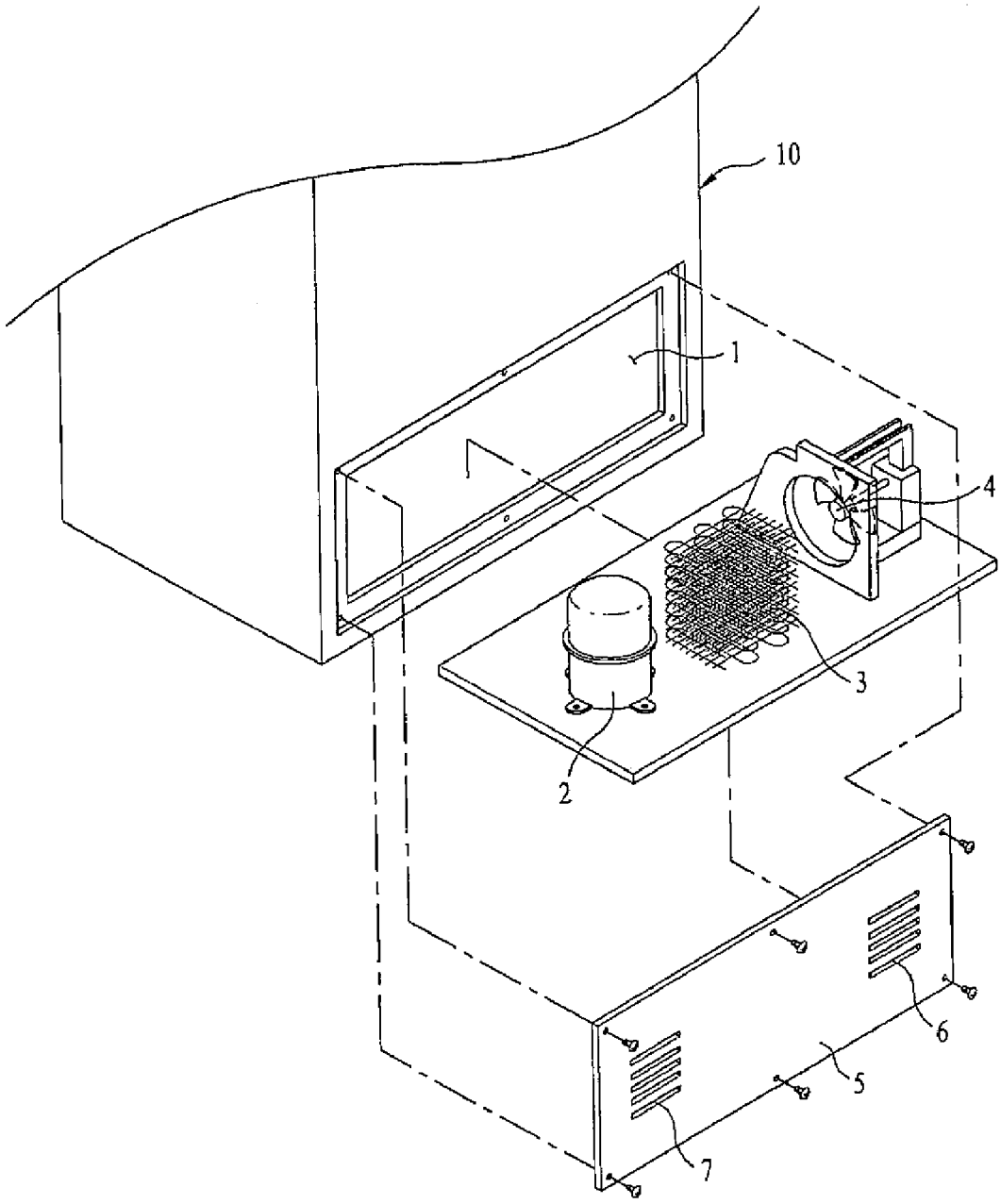
FIG. 1 is a view illustrating the configuration of a machine room provided in a related art refrigerator.
Figure 2:
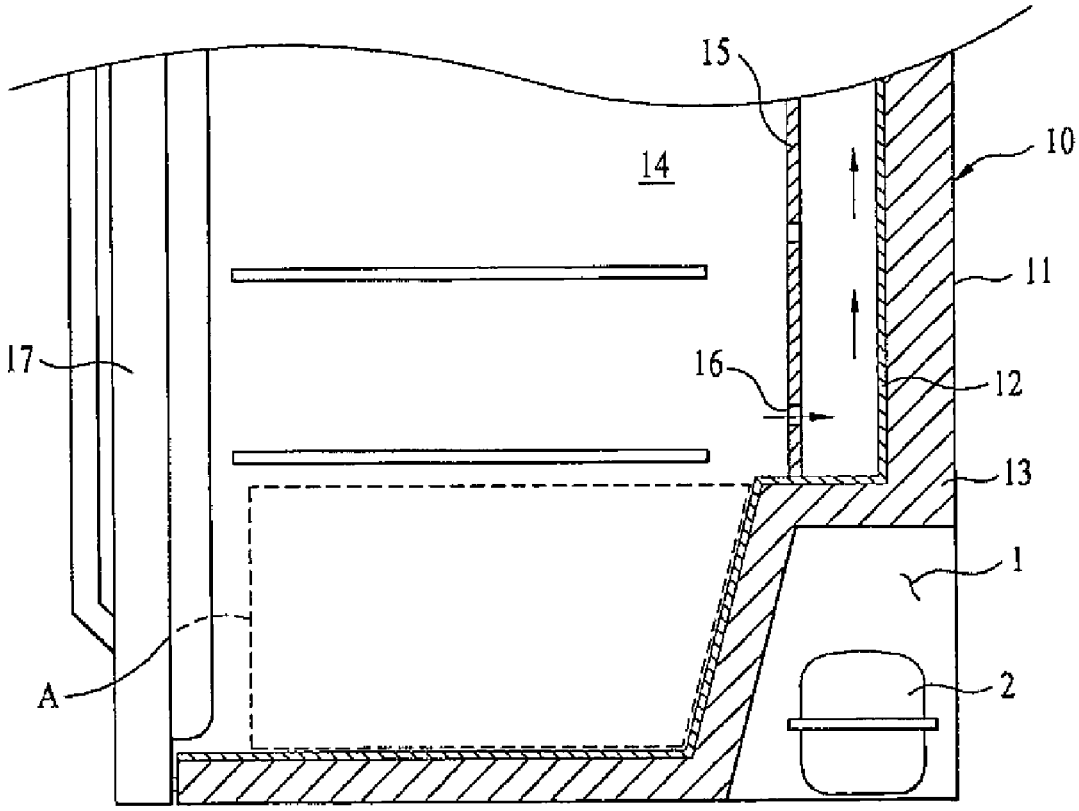
FIG. 2 is a side sectional view of the related art refrigerator.
Figure 3:
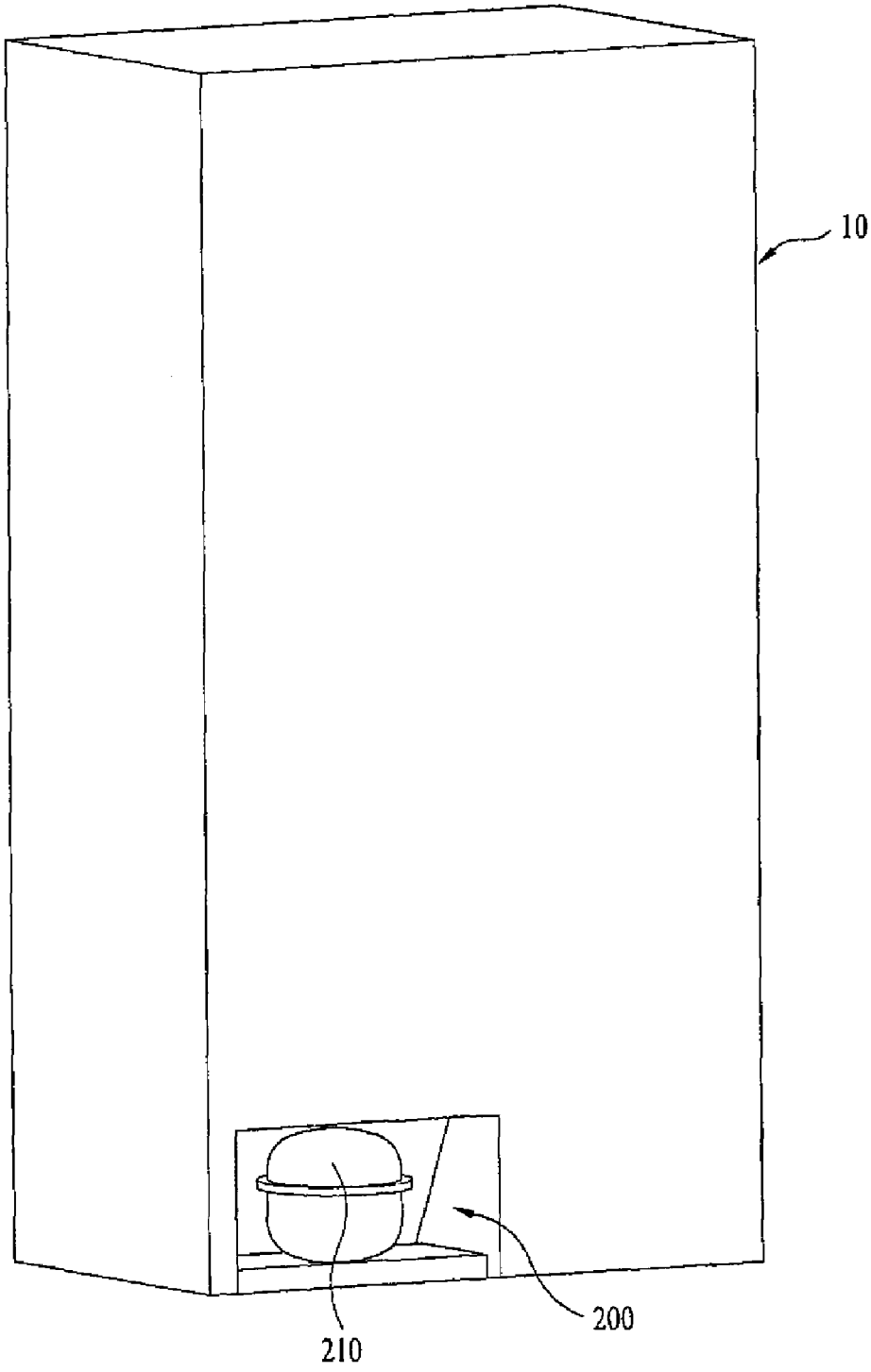
FIG. 3 is a rear perspective view of a refrigerator according to an embodiment of the present invention.
Figure 4:
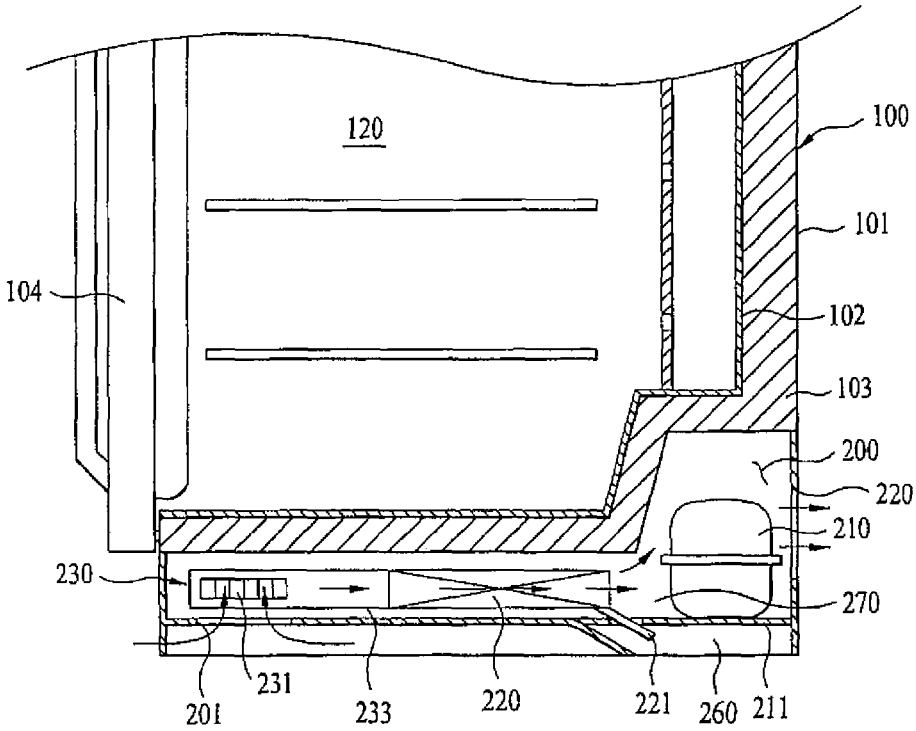
FIG. 4 is a side sectional view illustrating the configuration of a machine room provided in the refrigerator according to an embodiment of the present invention.

FIG. 3 illustrates a refrigerator according to an embodiment of the present invention. As shown in FIG. 3, the refrigerator includes a body 100 serving as the overall shell of the refrigerator, and a machine room 200 including a compressor 210. FIGS. 5, 6, 8 and 9 illustrate a first cooling compartment 110, and FIGS. 4 and 7 illustrate a second cooling compartment 120 defined in the body 100. The machine room 200 is provided only in a lower region of the second cooling compartment 120.

That is, as shown in FIGS. 5, 6, 8 and 9 the first cooling compartment 110 has no machine room, and can achieve an increment in inner volume of up to the volume of the machine room 200. Also, according to embodiments of the present invention, the inner volume of the machine room 200 can be reduced greatly. This has the effect of minimizing the loss of the inner volume of the second cooling compartment 120. The configuration of the machine room having such a greatly reduced inner volume will be described later with reference to FIGS. 4 to 9.

Meanwhile, although the refrigerator in one example only includes the two cooling compartments, it is also appreciated that the present invention is applicable equally to a refrigerator having three or more cooling compartments.

In the refrigerator according to embodiments of the present invention, the cooling compartments, as shown in FIGS. 5, 6, 8 and 9, are separated from each other by a partition 130. Consequently, the machine room 200 is defined by the partition 130. Alternatively, instead of defining the machine room 200 by the partition 130 another member may be employed as a partitioning member.

Figure 5:
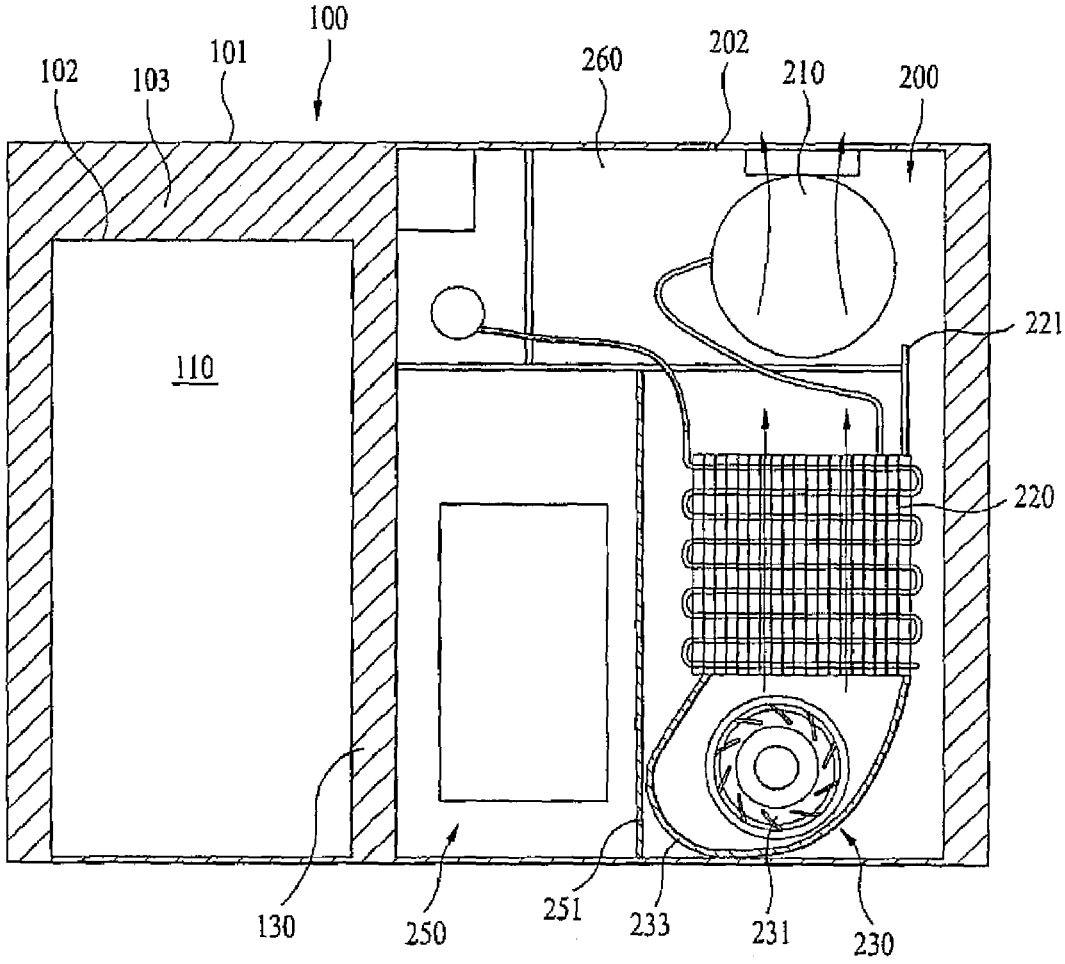
FIG. 5 is a top sectional view illustrating the configuration of the machine room provided in the refrigerator as shown in FIG. 4.

As shown in FIGS. 4 and 5, according to an embodiment of the present invention, the refrigerator includes the first cooling compartment 110 and the second cooling compartment 120 defined in the body 100, and the machine room 200 is provided in a lower region of the second cooling compartment 120.

The machine room 200 includes a flow passage 270 to allow air to move from the front side to the rear side of the refrigerator. The machine room 200 further includes a fan device 230, a condenser 220, and the compressor 210, which are successively arranged on the flow passage 270. Specifically, the fan device 230, the condenser 220, and the compressor 210 are successively arranged in a movement direction of the air along the flow passage 270.

Further, the flow passage 270 is provided at the entrance and the exit thereof with an air suction portion 201 and an air discharge portion 202. In operation, the air is suctioned through the air suction portion 201 by operation of the fan device 230 and moves along the flow passage 270 to cause the condensation of a refrigerant in the condenser 220. Then, after being used to cool the compressor 210 while passing through the compressor 210, the resulting air is discharged to the outside through the air discharge portion 202.

In addition, the air suction portion 201 is provided in at least one of a front surface of the body and a front position of a lower surface of the body, and the air discharge portion 202 is provided in at least one of a rear surface of the body and a rear position of the lower surface of the body. Here, the position of the air suction portion 201 can be changed according to the type of the fan device 230.

In an example, when the fan device 230 is a cross-flow fan that suctions air axially and blows the air radially, it is preferable that the air suction portion be provided in the front position of the lower surface of the body and the cross-flow fan be located above the air suction portion 201. In another example, when the fan device 230 is an axial-flow fan in which an air suction direction and an air blowing direction are approximately in a straight line, it is preferable that the air suction portion be formed in the front surface of the body.

In addition, when using the cross-flow fan, the air suction portion can be provided in any one of the front surface of the body and the front position of the lower surface of the body, and moreover, two air suction portions can be provided in both the front surface of the body and the front position of the lower surface of the body, respectively.

In the refrigerator according to the embodiment of the present invention as shown in FIGS. 4 and 5, the fan device 230 includes a radial-flow fan 231.

The body 100 defines the overall shell of the refrigerator including an outer shell 101 and an inner shell 102, and a heat-insulating material 103 is foamed and filled in a gap between the outer shell 101 and the inner shell 102. As shown in FIGS. 4 and 5, the radial-flow fan 231, the condenser 220, and the compressor 210 are successively arranged on the flow passage 270 of the machine room 200.

The radial-flow fan 231 is installed such that an axial direction of the radial-flow fan 231 coincides with a height direction of the body 100. Also, the condenser 220 is installed such that a relatively wider plane face of the condenser 220 is laid on the bottom of the flow passage 270.

Specifically, the condenser 220 has a predetermined length and a predetermined width, and a thickness smaller than the length and the width. The flow passage 270 preferably has a height larger than the thickness of the condenser 220, and smaller than the length and the width of the condenser 220.

With this configuration, as a result that the radial-flow fan 231 is installed such that the axial direction thereof coincides with the height direction of the body 100 and the condenser 220 is laid on the bottom of the flow passage 270, the height of the flow passage 270 can be reduced significantly. This consequently makes it possible to reduce the volume of the machine room 200.

Meanwhile, as shown in FIGS. 4 and 5, the radial-flow fan 231 is surrounded by a guide member 233. The guide member 233 serves to guide the air, blown radially from the radial-flow fan 231, to the condenser 220. In the present embodiment, the air suction portion 201 is located below the radial-flow fan 231, such that the air moving below the refrigerator is suctioned to the radial-flow fan 231 through the air suction portion 201, to thereby be blown in a radial direction of the radial-flow fan 231.

Further, the air discharge portion 202 is located behind the compressor 210, and is formed in a rear plate defining a rear lower wall of the refrigerator.

Accordingly, if the radial-flow fan 231 is rotated, the air is suctioned into the machine room 200 through the air suction portion 201. Then, after passing through the condenser 220 and being used to cool the compressor 210, the resulting air is discharged from the machine room 200 through the air discharge portion 202.

A rear region of the flow passage 270, in which the compressor 210 is located, has a height larger than a height of the remaining region of the flow passage 270, in which the radial-flow fan 231 and the condenser 220 are located, in due consideration of the size of the compressor 210.

In addition, a water sump 260 is provided in the machine room 200 below the installation region of the compressor 210 to collect and store condensate water generated from the condenser 220. To drain the collected water, the water sump 260 may be connected to the outside by use of a hose. Alternatively, the water sump 260 may be rearwardly separable from the refrigerator, to allow the user to manually throw away the water collected in the water sump 260.

Further, the condensate water generated from the condenser 220 is guided into the water sump 260 through a drain member 221. Although the compressor 210 can be placed on the water sump 260, it may be also considered that a certain supporting plate 211 is provided above the water sump 260 such that the compressor 210 can be placed on the supporting plate 211.

Meanwhile, as shown in FIG. 5, the machine room 200 includes an electric element chamber 250 in which certain electric elements are mounted. The electric element chamber 250 is separated from the flow passage 270 by a partition 251. Specifically, the partition 251 serves not only to define the flow passage 270, but also to separate the electric element chamber 250 and the flow passage 270 from each other.

Figure 6:
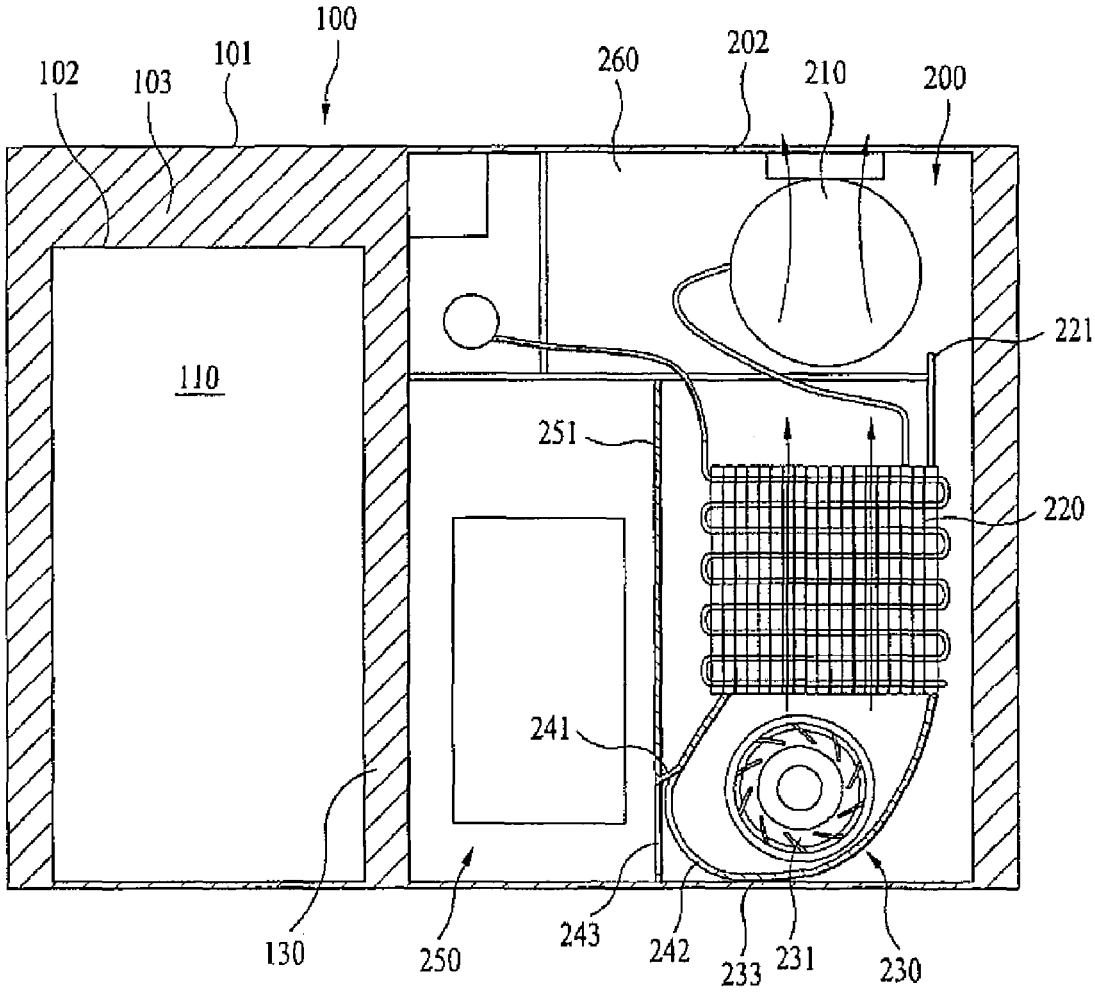
FIG. 6 is a top sectional view illustrating a modified configuration of the machine room provided in the refrigerator as shown in FIG. 4.
Figure 7:
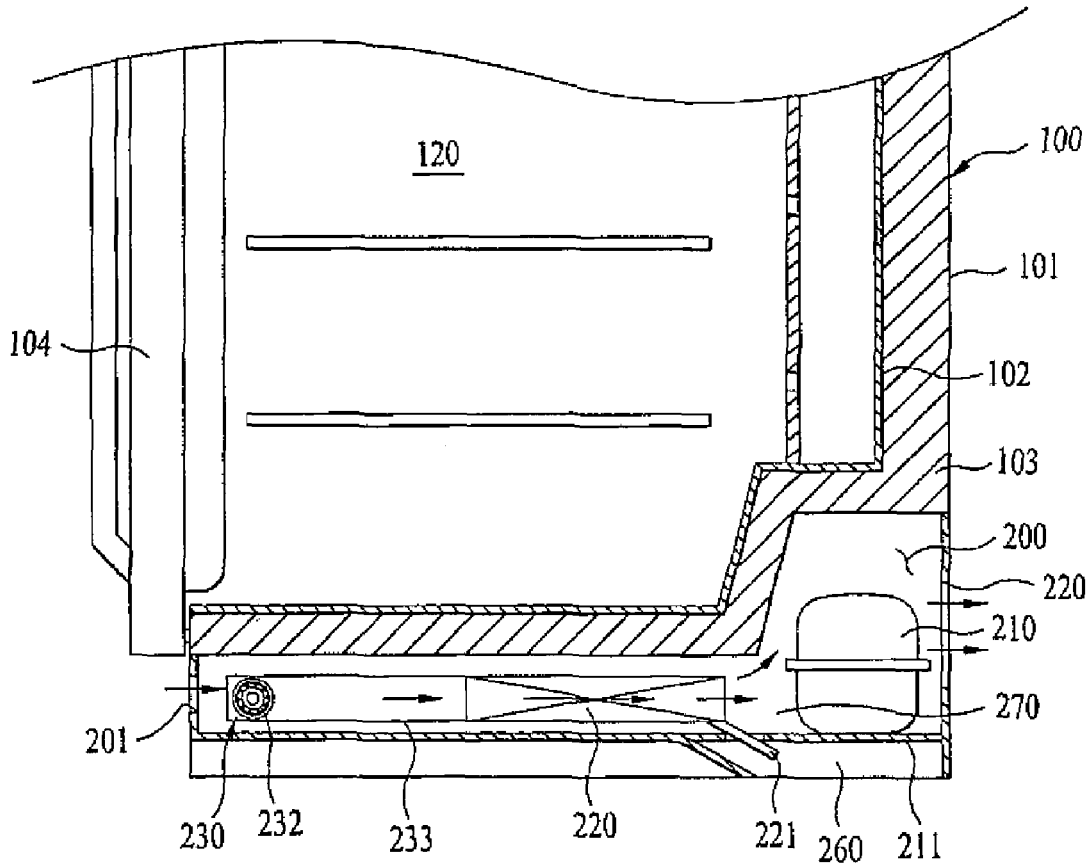
FIG. 7 is a side sectional view illustrating the machine room of a refrigerator according to another embodiment of the present invention.

Next, FIG. 6 illustrates the machine room 200 of the refrigerator according to another embodiment of the present invention. As shown in FIG. 6, the machine room 200 is configured such that a part of the air blown by the radial-flow fan 231 through the partition 251 is bypassed into the electric element chamber 250 through the partition 251, to allow the electric element chamber 250 and the machine room 200 to be cooled simultaneously.

As shown in FIG. 6, the partition 251 includes an inlet hole 243, and the guide member 233 includes a bypass hole 242. The machine room 200 of the present embodiment further includes a bypass guide 241 provided to connect the inlet hole 243 and the bypass hole 242 with each other, thereby communicating the electric element chamber 250 and the interior of the guide member 233 with each other.

Under operation of the radial-flow fan 231, a part of the blown air moves to the condenser 220 along the flow passage 270, and the remaining air passes through the bypass hole 242 and is guided by the bypass guide 241 to thereby be introduced into the electric element chamber 250 through the inlet hole 243. In this way, the part of the air can be used to cool the electric element chamber 250.

Other configurations of the present embodiment, for example, related to the flow passage 270, air suction and discharge portions, radial-flow fan 231, guide member 233, condenser 220, compressor 210, and the drainage of condensate water, etc. are substantially identical to those of the previously described embodiment with relation to FIGS. 4 and 5, and thus, a detailed description thereof will be omitted.

Figure 8:
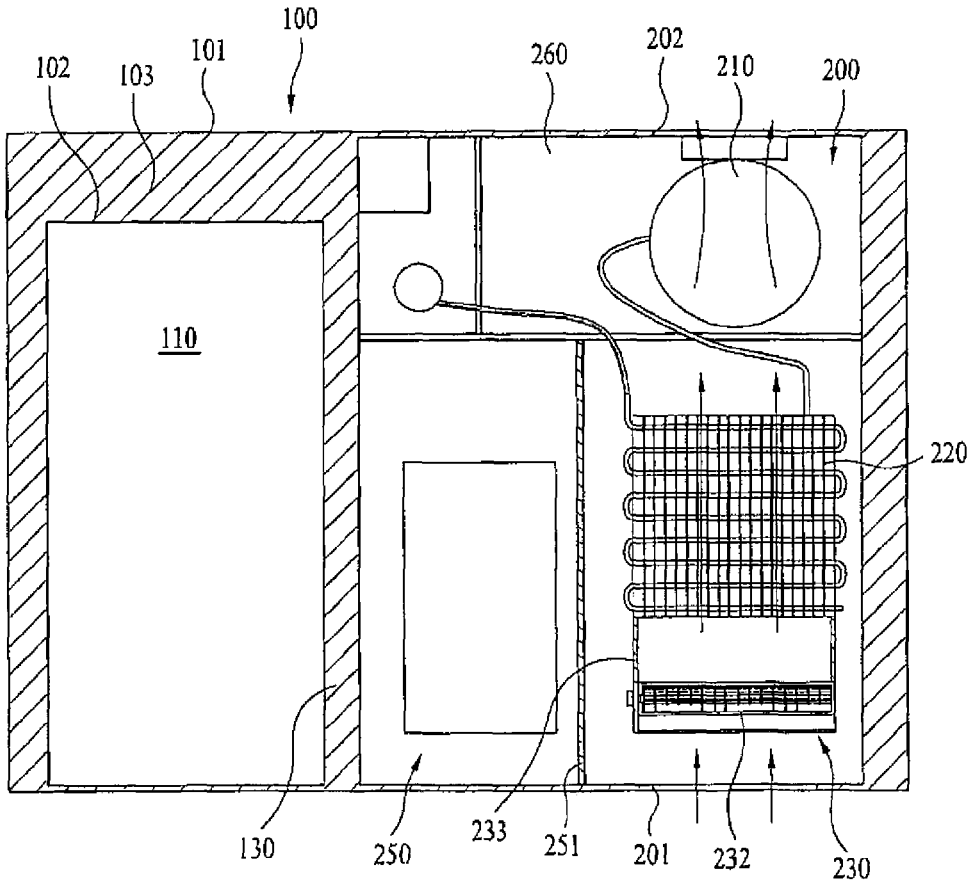
FIG. 8 is a top sectional view illustrating the machine room of the refrigerator shown in FIG. 7.

FIGS. 7 and 8 illustrate the machine room of the refrigerator according to a further embodiment of the present invention, in which a cross-flow fan 232 is used as the fan device 230. As shown in FIGS. 7 and 8, the cross-flow fan 232, the condenser 220, and the compressor 210 are successively arranged on the flow passage 270 of the machine room 200.

With the use of the cross-flow fan 232, similarly, the air suction portion may be provided in any one of the front surface and the lower surface of the refrigerator, or two air suction portions may be provided in both the front and rear surfaces of the refrigerator, respectively.

Further, the condenser 220 has a predetermined length and a predetermined width, and a thickness smaller than the length and the width. The flow passage 270 preferably has a height larger than the thickness of the condenser 220, and smaller than the length and the width of the condenser 220.

In the present embodiment, the cross-flow fan 232 is installed such that an axial direction of the fan 232 coincides with a width direction of the body 100 and the condenser 220 is laid on the bottom of the flow passage 270. With this configuration, the height of the flow passage 270 can be reduced significantly, and this consequently makes it possible to reduce the volume of the machine room 200.

Meanwhile, as shown in FIGS. 7 and 8, the guide member 233 is provided between the cross-flow fan 232 and the condenser 220. The guide member 233 serves to guide the air, blown from the cross-flow fan 232, to the condenser 220.

Although the present embodiment illustrates that the air suction portion 201 is formed in the front surface of the refrigerator, the position of the air suction portion 201 is not limited thereto. For example, the air suction portion 201 may be formed in the lower surface of the refrigerator, and two air suction portions may be formed in the front and lower surfaces of the refrigerator, respectively.

The air discharge portion 202 is located behind the compressor 210, and is formed in the rear plate defining the rear lower wall of the refrigerator. Accordingly, if the cross-flow fan 232 is rotated, the air is suctioned into the machine room 200 through the air suction portion 201. Then, after passing through the condenser 220 and being used to cool the compressor 210, the resulting air is discharged from the machine room 200 through the air discharge portion 202.

A rear region of the flow passage 270, in which the compressor 210 is located, has a height larger than a height of the remaining region of the flow passage 270, in which the cross-flow fan 232 and the condenser 220 are located, in due consideration of the size of the compressor 210.

The water sump 260 is provided in the machine room 200 below the installation region of the compressor 210 to collect and store condensate water generated from the condenser 220. To drain the collected water, the water sump 260 may be connected to the outside by use of a hose. Alternatively, the water sump 260 may be rearwardly separable from the refrigerator, to allow the user to manually throw the water collected in the water sump 260. The condensate water generated from the condenser 220 is guided into the water sump 260 through the drain member 221.

Although the compressor 210 can be placed on the water sump 260, it may be also considered that the supporting plate 211 is provided above the water sump 260 such that the compressor 210 can be placed on the supporting plate 211.

Meanwhile, the machine room 200 includes the electric element chamber 250 in which certain electric elements are mounted. The electric element chamber 250 is separated from the flow passage 270 by the partition 251. Specifically, the partition 251 serves not only to define the flow passage 270, but also to separate the electric element chamber 250 and the flow passage 270 from each other.

Figure 9:
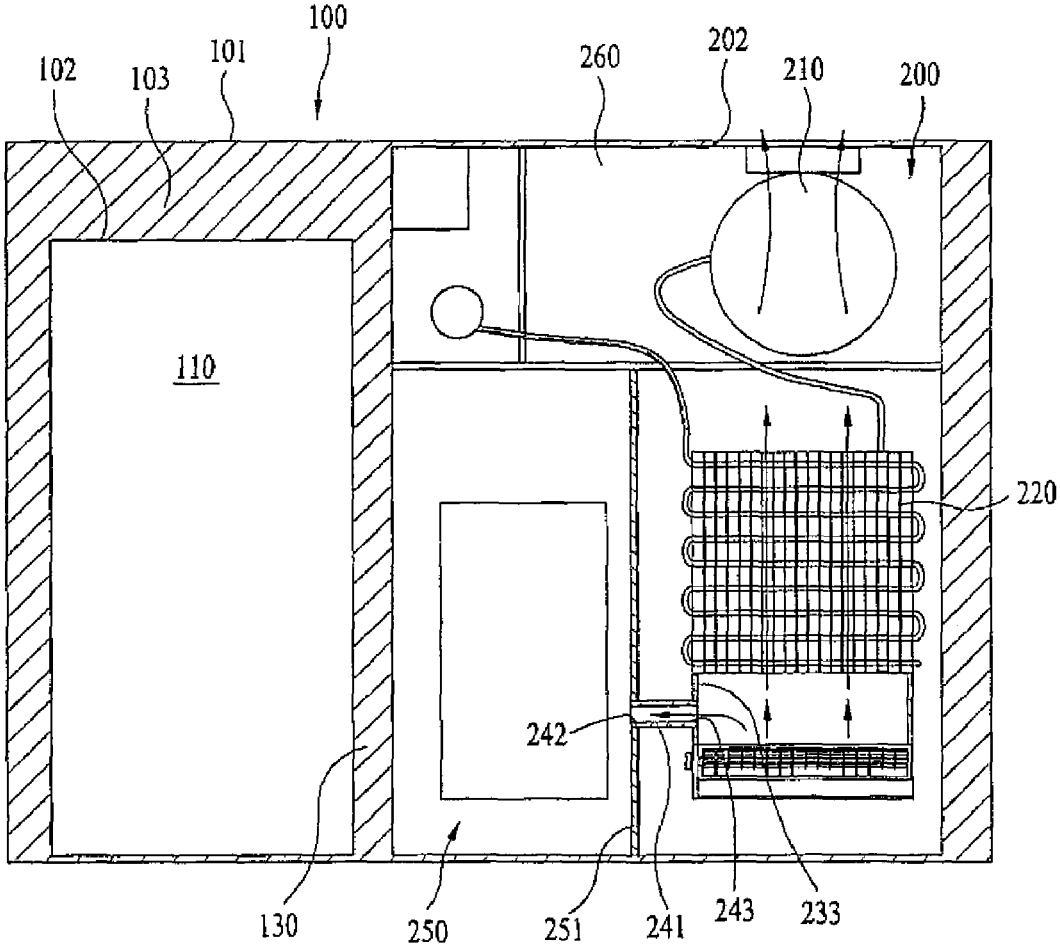
FIG. 9 is a view illustrating a modified configuration of the machine room provided in the refrigerator according to FIG. 7.

Next, FIG. 9 illustrates the machine room 200 of the refrigerator according to yet another embodiment of the present invention. As shown in FIG. 9, the machine room 200 is configured such that a part of the air blown by the cross-flow fan through the partition 251 is bypassed into the electric element chamber 250 through the partition 251, to allow the electric element chamber 250 and the machine room 200 to be cooled simultaneously.

As shown in FIG. 9, the partition 251 includes the inlet hole 243, and the guide member 233 includes the bypass hole 242. The machine room 200 further includes the bypass guide 241 provided to connect the inlet hole 243 and the bypass hole with each other, thereby communicating the electric element chamber 250 and the interior of the guide member 233 with each other.

Under operation of the cross-flown fan, a part of the blown air moves to the condenser 220 along the flow passage 270, and the remaining air passes through the bypass hole 242 and is guided by the bypass guide 241 to thereby be introduced into the electric element chamber 250 through the inlet hole 243. In this way, the part of the air can be used to cool the electric element chamber 250.

Other configurations of the present embodiment, for example, related to the flow passage 270, air suction and discharge portions 201/202, cross-flow fan 232, guide member 233, condenser 220, compressor 210, and the drainage of condensate water, etc. are substantially identical to those of the previously described embodiment with relation to FIGS. 7 and 8, and thus, a detailed description thereof will be omitted.

As apparent from the above description, in the refrigerator according to the present invention, a machine room can be provided in a lower region of any one of a plurality of cooling compartments, and the height of the machine room can be reduced greatly. This has the effect of not only enlarging the volume of the remaining cooling compartment to the maximum extent, but also minimizing the loss of the volume of the cooling compartment having the machine room. In conclusion, the present invention achieves a reduced size of the machine room and enlarges the inner volume of the cooling compartment It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator, comprising:

a body having a plurality of cooling compartments separated from each other by a partition; and a machine room defined by the partition and located in a lower region of only one of the plurality of cooling compartments, the machine room receiving predetermined elements required to operate the cooling compartments, wherein the machine room comprises:

a flow passage extending from a front side to a rear side of the body, to allow the movement of air;

an electric chamber to receive predetermined electric elements and a bypass structure to communicate the flow passage with the electric element chamber so as to allow a part of the air moving in the flow passage to be bypassed into the electric chamber, wherein the flow passage comprises:

an air suction portion provided in at least one of a front surface of the body and a front position of a lower surface of the body; and an air discharge portion provided in at least one of a rear surface of the body and a rear position of the lower surface of the body, wherein the flow passage is provided therein with a compressor, a condenser, and a fan device, wherein the condenser has a predetermined length, a predetermined width, and a thickness smaller than the length and the width and is arranged in the flow passage horizontally, wherein a partial region of the flow passage is arranged to receive the fan device and the condenser and has a height larger than the thickness of the condenser and smaller than the length and the width of the condenser so that the partial region of the flow passage has a height smaller than the height of the compressor, and wherein the fan device includes a radial-fan or a cross-flow fan to suction air through the air suction portion and blow the air to the condenser.

2. The refrigerator according to claim 1, wherein the fan device, the condenser, and the compressor are successively arranged starting from the air suction portion toward the air discharge portion.

3. The refrigerator according to claim 1, further comprising:

a guide member to guide the air, blown from the fan device, to the condenser.

4. The refrigerator according to claim 3, wherein the air suction portion is provided in the front surface of the body, and wherein the fan device includes the cross-flow fan to suction air through the air suction portion and blow the air to the condenser.

5. The refrigerator according to claim 3, wherein the air suction portion is provided in the front position of the lower surface of the body, and wherein the fan device includes the radial-flow fan to suction air through the air suction portion and blow the air to the condenser.

6. A refrigerator comprising:

a body having a plurality of cooling compartments separated from each other by a partition; and a machine room defined, by the partition, in a lower region of one of the plurality of cooling compartments, the machine room receiving predetermined elements required to operate the cooling compartments, wherein the machine room comprises:

a flow passage extending from a front side to a rear side of the body, to allow the movement of air, an electric element chamber to receive predetermined electric elements; and a bypass structure to communicate the flow passage with the electric element chamber, so as to allow a part of the air moving in the flow passage to be bypassed into the electric element chamber.

7. A refrigerator comprising:

a body having a plurality of cooling compartments separated from each other by a partition; and a machine room defined, by the partition, in a lower region of one of the plurality of cooling compartments, the machine room receiving predetermined elements required to operate the cooling compartments including a compressor, a condenser, and a fan device, the machine room including:

a flow passage extending from a front side to a rear side of the body, to allow the movement of air, the flow passage being provided therein the compressor, the condenser, and the fan device;

a guide member to guide the air, blown from the fan device, to the condenser;

an electric element chamber to receive predetermined electric elements;

a partition to separate the electric element chamber from the flow passage; and a bypass guide to communicate a bypass hole formed in the guide member and an inlet hole formed in the partition with each other.

* * * * *